US011339583B2

(12) United States Patent
Watson et al.

(10) Patent No.: US 11,339,583 B2
(45) Date of Patent: May 24, 2022

(54) DOOR-ILLUMINATING HANDLE

(71) Applicant: Schlage Lock Company LLC, Carmel, IN (US)

(72) Inventors: Aida K. N. Watson, Noblesville, IN (US); Madeline Ryals, Clarksville, TN (US); Nicholas Upton, Indianapolis, IN (US); Chris R. Snider, Noblesville, IN (US); Parth Kashikar, Boise, ID (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 17/064,236

(22) Filed: Oct. 6, 2020

(65) Prior Publication Data

US 2021/0189761 A1 Jun. 24, 2021

Related U.S. Application Data

(63) Continuation of application No. 16/552,573, filed on Aug. 27, 2019.

(51) Int. Cl.

| | |
|---|---|
| ***E05B 1/00*** | (2006.01) |
| ***F21V 23/04*** | (2006.01) |
| ***F21S 9/02*** | (2006.01) |
| ***E05B 17/10*** | (2006.01) |
| *F21Y 115/10* | (2016.01) |

(52) U.S. Cl.

CPC ..... *E05B 1/0007* (2013.01); *E05B 17/10* (2013.01); *F21S 9/02* (2013.01); *F21V 23/0464* (2013.01); *F21V 23/0471* (2013.01); *F21Y 2115/10* (2016.08)

(58) Field of Classification Search

CPC ..... E05B 17/10; E05B 1/0007; F21V 11/08; F21V 11/14

See application file for complete search history.

(56) References Cited

U.S. PATENT DOCUMENTS

| | | | |
|---|---|---|---|
| 2,676,244 | A | 4/1954 | Dittman |
| 3,314,746 | A | 4/1967 | Millar |
| 3,338,613 | A | 8/1967 | Kendrick |
| 6,132,057 | A | 10/2000 | Williams |
| 6,729,740 | B1 | 5/2004 | Gazard |
| 7,248,163 | B2 | 7/2007 | Wu |
| 7,568,829 | B2 | 8/2009 | Chien |
| 7,878,672 | B2 | 2/2011 | Yang |
| 7,922,348 | B2 | 4/2011 | Razeto |

(Continued)

OTHER PUBLICATIONS

International Search Report; International Searching Authority; International Application No. PCT/US2020/048209; dated Oct. 29, 2020; 3 pages.

(Continued)

*Primary Examiner* — Robert J May

(74) *Attorney, Agent, or Firm* — Taft Stettinius & Hollister LLP

(57) ABSTRACT

A door handle is configured for mounting to a door, and includes a shell having a front side and a rear side, with the shell defining an internal chamber. A shank extends from the rear side of the shell, and a light source is seated in the internal chamber. A window pattern is positioned on the rear side of the shell such that the light source is operable to project onto the door a light pattern corresponding to the window pattern.

24 Claims, 8 Drawing Sheets

(56) References Cited

U.S. PATENT DOCUMENTS

| | | | | |
|---|---|---|---|---|
| 9,200,771 | B2 | 12/2015 | Brennan | |
| 10,342,090 | B2 * | 7/2019 | Noeldner | H05B 45/10 |
| 10,352,512 | B1 | 7/2019 | Smith | |
| 2010/0219957 | A1 | 9/2010 | Jolley et al. | |
| 2013/0070440 | A1 * | 3/2013 | Levermore | G09F 19/18 362/84 |
| 2016/0050736 | A1 | 2/2016 | Hoang | |
| 2017/0236389 | A1 | 8/2017 | Tang | |

OTHER PUBLICATIONS

Written Opinion of the International Searching Authority, International Searching Authority; International Application No. PCT/US2020/048209; dated Oct. 29, 2020; 5 pages.

* cited by examiner

DOOR-ILLUMINATING HANDLE

CROSS REFERENCE TO RELATED APPLICATIONS

This application is a continuation of U.S. patent application Ser. No. 16/552,573 filed Aug. 27, 2019 and issued as U.S. Pat. No. 10,794,082, the contents of which are incorporated herein by reference in their entirety.

TECHNICAL FIELD

The present disclosure generally relates to door handles, and more particularly but not exclusively relates to lighted door knobs.

BACKGROUND

While certain existing door handles include lights, these lights are generally provided to convey information related to the status of the door, and typically do not enhance the overall aesthetic of the door or the handle. For these reasons among others, there remains a need for further improvements in this technological field.

SUMMARY

An exemplary door handle is configured for mounting to a door, and includes a shell having a front side and a rear side, the shell defining an internal chamber. A shank extends from the rear side of the shell, and a light source is seated in the internal chamber. A window pattern is positioned on the rear side of the shell such that the light source is operable to project onto the door a light pattern corresponding to the window pattern. Further embodiments, forms, features, and aspects of the present application shall become apparent from the description and figures provided herewith.

DETAILED DESCRIPTION OF ILLUSTRATIVE EMBODIMENTS

Figure 2:
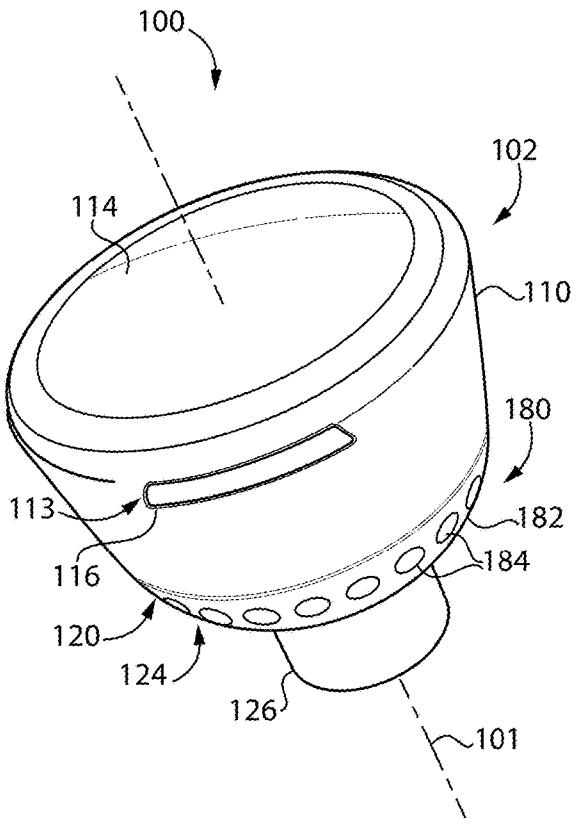
FIG. 2 is a perspective illustration of the knob illustrated in FIG. 1.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

Figure 1:
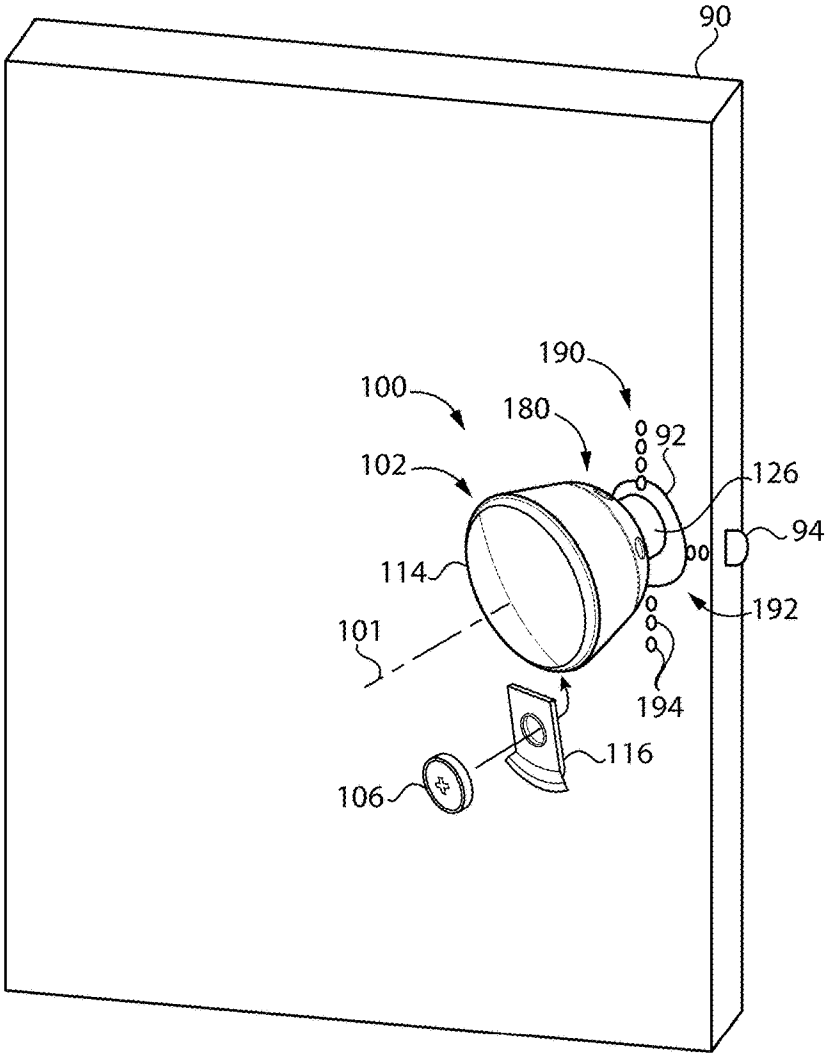
FIG. 1 is a perspective illustration of a door having installed thereon a knob according to certain embodiments.

With reference to FIG. 1, illustrated therein is a door 90 having mounted thereon a door-illuminating handle in the form of a knob 100 according to certain embodiments. As described herein, the knob 100 includes a window pattern 180 and has mounted therein a light source operable to project light through the window pattern 180 such that a corresponding light pattern 190 is cast onto the door 90. While the illustrated handle is provided in the form of a knob 100, it is also contemplated that the handle may be provided in another form, such as that of a lever. An example of such a lever is described below with reference to FIG. 11.

The door 90 includes a trim 92 to which the handle 100 is mounted. In certain embodiments, the trim 92 may include a latchbolt 94 operable to secure the door 90 to a doorframe in a closed position. In such forms, the knob 100 may be rotatable about a rotational axis 101 defined by a shank 126 of the knob 100, and the trim 92 may be configured to move the latch 94 between an extended position and a retracted position in response to rotation of the knob 100. It is also contemplated that the trim 92 may be provided as a dummy trim, in which case the knob 100 may not necessarily be operable to rotate about the rotational axis 101, and the latchbolt 94 may be omitted. In certain embodiments, the trim 92 and the knob 100 may be provided together at the time of sale, while in other embodiments, the knob 100 may be provided as a separate component configured for use with the trim 92.

With additional reference to FIG. 2, the knob 100 includes a shell 102 defining a front side or front face 114, a rear side or rear face 124, and a shank 126 extending from the rear face 124. When the knob 100 is installed to the door 90, the front face 114 faces a room adjacent the door 90, and the rear face 124 faces the door 90. The rear face 124 includes the window pattern 180 such that the window pattern 180 faces the door 90 when the knob 100 is installed to the trim 92.

Figure 3:
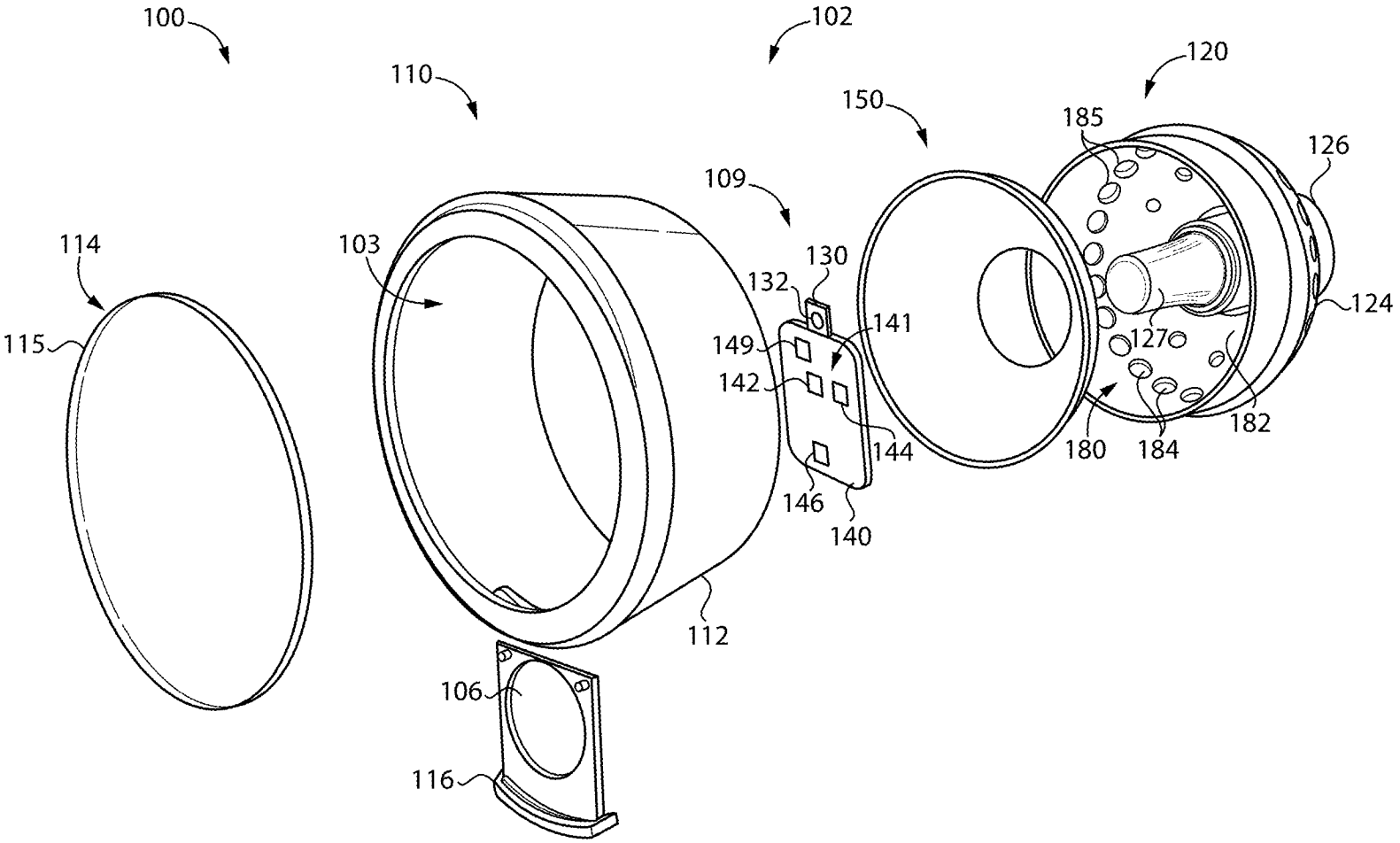
FIG. 3 is an exploded assembly view of the knob illustrated in FIGS. 1 and 2.

With additional reference to FIG. 3, the illustrated knob 100 generally includes a front portion 110 and a rear portion 120. The front portion 110 and the rear portion 120 are coupled to one another to form the shell 102, which is generally hollow such that a chamber 103 is defined therein. Disposed within the chamber 103 is a light source 130 and control circuitry 140 that controls operation of the light source 130. The knob 100 may further include a light modulator 150 positioned between the light source 130 and the window pattern 180.

In the illustrated embodiment, the front portion 110 includes a collar 112 and the front face 114. The front face 114 may be mounted to or integrally formed with the collar 112. A slot 113 is formed in the collar 112, and a battery holder 116 is slidably received in the slot 113. A battery 106 such as a coin cell battery is held by the battery holder 116 and is in contact with the control circuitry 140 such that the control circuitry 140 is operable to draw power from the battery 106. In certain embodiments, the front face 114 may be provided as a transparent or translucent shield 115 such that sensors 142, 144 of the circuitry 140 are operable to detect environmental conditions via the transparent or translucent shield. In other embodiments, the front face 114 may be opaque, and may be integrally formed with the collar 112. Additionally, the shield 115 may be designed to conform to the overall aesthetic of the knob 100, for example by being tinted a color corresponding to the color of the shell 102. By way of illustration, in embodiments in which the shell 102 is provided in black, the shield 115 may be tinted black.

The rear portion 120 is secured to the front portion 110 such that the chamber 103 is defined within the shell 102. The rear portion 120 includes the rear face 124 and the shank 126, which projects from the rear face 124. Located at the rear face 124 is the window pattern 180, which in the illustrated form is defined by the rear face 124. The shank 126 is sized and shaped to receive a spindle of the trim 92 such that the knob 100 is operable to be mounted to the trim 92. The shank 126 may include an extension 127 that extends into the chamber 103. In the illustrated form, the rear portion 120 is formed of an opaque material such as metal, and has the window pattern 180 defined as a plurality of openings formed in the opaque material. It is also contemplated that other materials may be used. For example, the rear portion 120 may be defined at least in part by a translucent or transparent material such as glass, and may have the window pattern 180 printed or otherwise mounted thereon.

The light source 130 is in communication with the control circuitry 140, which controls operation of the light source 130. The light source 130 may, for example, comprise one or more light-emitting diodes (LEDs) 132. It is also contemplated that the light source 130 may include another form of light generator, such as an incandescent light source and/or a fluorescent light source. As described herein, illumination of the light source 130 causes the light pattern 190 to be displayed on the door 90. In certain forms, the light source 130 may be a single-color light source, while in other embodiments, the light source 130 may be operable to generate light of various colors. For example, the light source 130 may be provided as a red-green-blue (RGB) LED array operable to selectively generate various colors.

Figure 4:
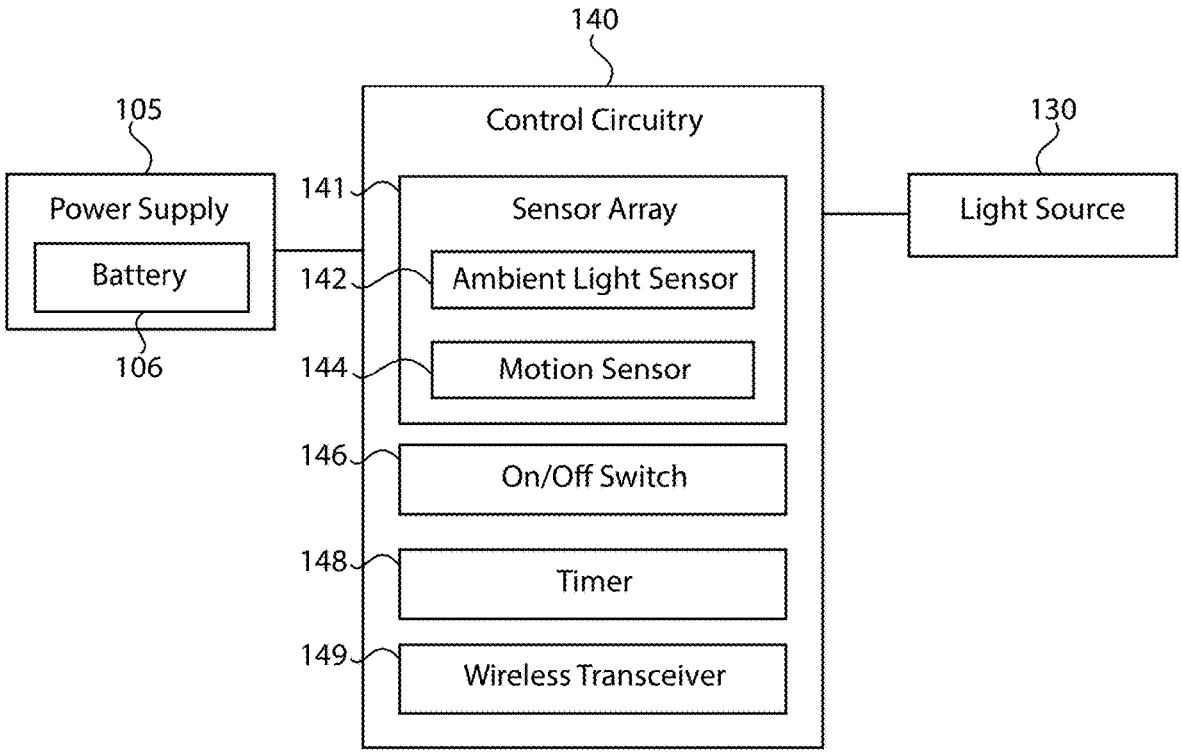
FIG. 4 is a schematic block diagram of control circuitry according to certain embodiments.

With additional reference to FIG. 4, the control circuitry 140 is configured to control operation of the light source 130, and may, for example, be provided as a printed circuit board assembly (PCBA) 109. In the illustrated form, the circuitry 140 draws power from an onboard power supply 105 in the form of the battery 106. In other embodiments, the circuitry 140 may draw power from another form of power supply 105, such as line power or a photovoltaic cell that charges a battery or supercapacitor. The control circuitry 140 may include a sensor array 141, an on/off switch 146, a timer 148, and/or a wireless transceiver 149, each of which may facilitate control of the light source 130 as described herein. The sensor array 141 includes one or more sensors, such as an ambient light sensor 142 and/or a motion sensor 144.

In embodiments that include the light modulator 150, the light modulator 150 may be positioned in the chamber 103 between the light source 130 and the window pattern 180, and is configured to alter or modulate the light emitted by the light source 130 as the light passes toward the window pattern 180. The light modulator 150 may be sized and shaped to generally conform to the inner surface of the chamber 103, and includes an aperture 152 through which the extension 127 extends. The light modulator 150 may be provided as a light diffuser, which may be a translucent or frosted member configured to diffuse the light passing therethrough. Additionally or alternatively, the light modulator may be provided as a lens configured to diffract the light passing therethrough.

The window pattern 180 includes at least one opaque region 182 and at least one translucent or transparent region 184. While other forms are contemplated, in the illustrated embodiment, the window pattern 180 includes a plurality of generally circular transparent regions 184 in the form of apertures 185 defined in the rear face 124. When the light source 130 is illuminated, the opaque region 182 casts a shadow on the door 90 to define a darkened region 192 of the light pattern 190, and the light passes through the translucent or transparent regions 184 to define lightened areas 194 of the light pattern 190. In the illustrated form, the pattern 180 is an ornamental pattern intended to be aesthetically pleasing to the user. In other forms, the pattern may display information. For example, a pattern may be configured to display the word "EXIT" for use at an exit of a building.

In the illustrated form, the window pattern 180 is defined by the rear portion 120 of the shell 102. More particularly, the opaque region 182 is defined as the solid or positive material of the rear portion 120, and the translucent or transparent regions 184 are negative spaces or apertures 185 formed in the rear face 124. As described herein, however, it is also contemplated that the window pattern 180 may be defined at least in part by a removable component that is releasably coupled to the shell 102. Additionally, while the illustrated apertures 185 are substantially circular, it is also contemplated that other geometries may be utilized. Certain illustrative geometries and arrangements for the window pattern 180 and corresponding light patterns 190 are illustrated in FIG. 12*a*-12*i*.

As noted above, operation of the light source 130 is controlled by the control circuitry 140. In the illustrated embodiment, the control circuitry 140 is configured to control operation of the light source 130 based at least in part upon information received from the sensor array 141. As described herein, the control of the light source 130 may be further based upon a comparison of the information to at least one criterion.

In certain embodiments, the sensor array 141 may include an ambient light sensor 142 operable to sense a level of ambient light in the vicinity of the knob 100. In such forms, the at least one criterion may include a criterion related to the level of ambient light sensed by the ambient light sensor 142. For example, the circuitry 140 may illuminate the light source 130 when the information from the ambient light sensor 142 indicates that the area in the vicinity of the door 90 is darkened. In the illustrated embodiment, the front face 114 is translucent such that the ambient light sensor 142 is operable to sense the ambient light level through the translucent front face 114. Additionally or alternatively, the front face 114 may include an opening through which the ambient light sensor 142 is operable to sense the level of ambient light.

In certain embodiments, the sensor array 141 may include a motion sensor 144 operable to sense motion in the vicinity of the knob 100. In such forms, the at least one criterion may include a criterion related to motion sensed by the motion sensor 144. For example, the circuitry 140 may illuminate the light source 130 when the information from the motion sensor 144 indicates that movement is occurring or has recently occurred in the proximity of the door 90. In the illustrated embodiment, the front face 114 is translucent such that the motion sensor 144 is operable to sense the movement through the translucent front face 114. Additionally or alternatively, the front face 114 may include an opening through which the motion sensor 144 is operable to sense the movement. The circuitry 140 may further include a timer 148 such that the light source 130 remains illuminated for a predetermined amount of time after the most recent occurrence of movement.

In certain forms, the sensor array 141 may include both the ambient light sensor 142 and the motion sensor 144. In such forms, the at least one criterion may include a first criterion related to the level of ambient light sensed by the ambient light sensor 142 and a second criterion related to motion sensed by the motion sensor 144. For example, the circuitry 140 may illuminate the light source 130 when the information from the ambient light sensor 142 indicates that the area adjacent the door 90 is darkened and the information from the motion sensor 144 indicates that movement is occurring or has recently occurred in the proximity of the door 90. The timer 148 may be provided such that the light source 130 remains illuminated for a predetermined amount of time after the most recent occurrence of movement while the area in the vicinity of the knob 100 is dark.

As noted above, the circuitry 140 may further include an on/off switch 146. In certain forms, the on/off switch 146 may have an always-on state in which the circuitry 140 maintains the light source 130 in an illuminated state at all times. In certain forms, the on/off switch 146 may operate in conjunction with the timer 148 such that the light source 130 remains activated for a predetermined period of time after activation of the on/off switch 146. In certain forms, the on/off switch 146 may have an always-off state in which the circuitry 140 maintains the light source 130 in a deactivated state at all times. In certain forms, the on/off switch 146 may have a selectively-on state in which the circuitry 140 selectively illuminates the light source based on at least one criterion, for example as described above.

In certain embodiments, the timer 148 may cause the light source 130 to be selectively activated regardless of the presence or absence of information relating to movement. For example, the timer 148 may cause the light source 130 to be illuminated at certain times of day (e.g., at least a portion of the night), while causing the light source 130 to remain unilluminated during other times of the day (e.g., during daylight hours).

In certain embodiments, control of the light source 130 may be based at least in part upon information received via the wireless transceiver 149. The wireless transceiver 149 may, for example, be provided in the form of a Bluetooth transceiver and/or a Wi-Fi transceiver. The wireless transceiver 149 may facilitate the use of the knob 100 as a component of a smart home system and/or as a component of an Internet of Things (IoT) network. Additionally or alternatively, the wireless transceiver 149 may be used to wirelessly connect the control circuitry 140 with a mobile device (e.g., a smartphone or tablet) such that operation of the light source 130 can be controlled via an app installed to the mobile device.

Figure 5:
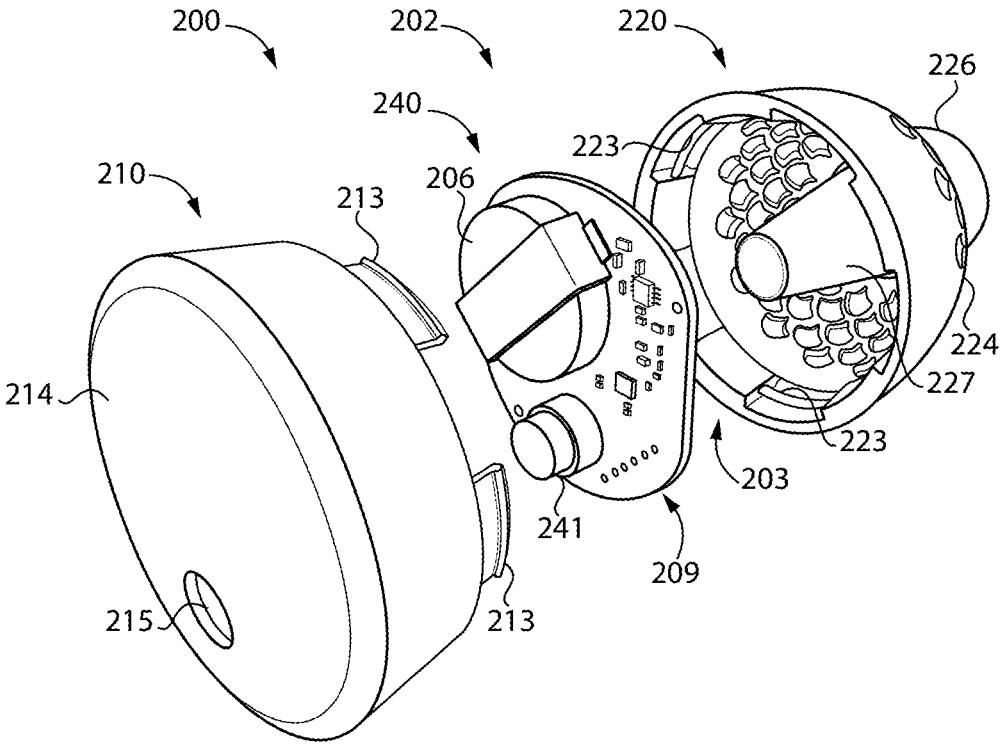
FIG. 5 is a first exploded assembly view of a knob according to certain embodiments.
Figure 6:
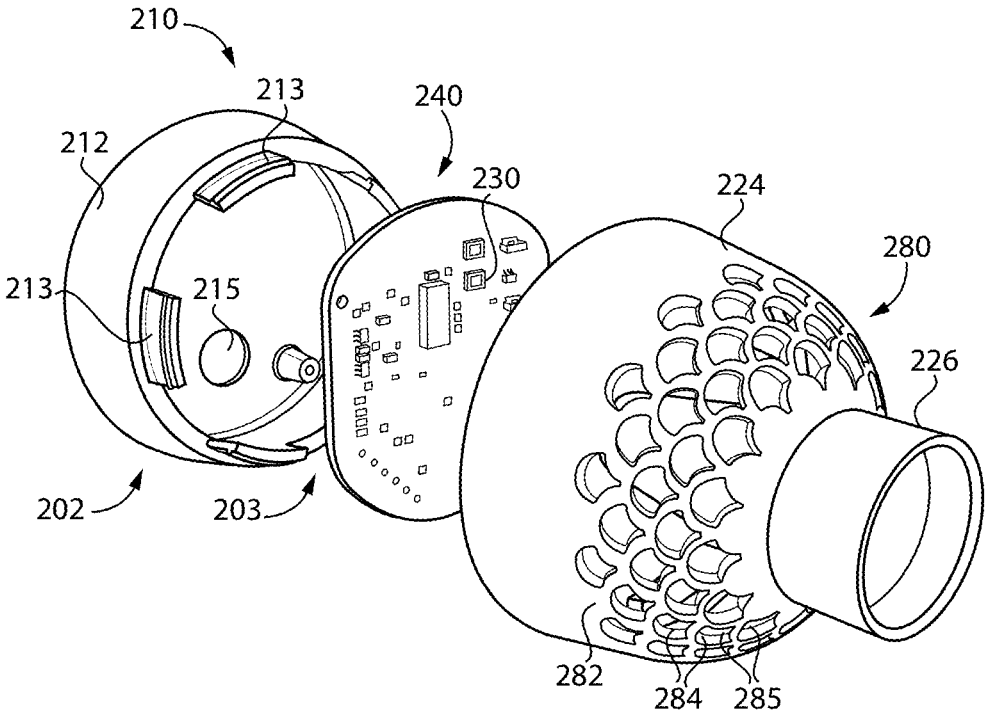
FIG. 6 is a second exploded assembly view of the knob illustrated in FIG. 5.

With additional reference to FIGS. 5 and 6, illustrated therein is a knob 200 according to certain embodiments. The knob 200 is substantially similar to the above-described knob 100, and similar reference characters are used to indicate similar elements and features. For example, the knob 200 includes a light source 230, control circuitry 240, and a shell 202 having a front portion 210 and a rear portion 220 that cooperate to define a chamber 203, which respectively correspond to the above-described light source 130, control circuitry 140, and shell 102 having a front portion 110 and a rear portion 120 that cooperate to define a chamber 203. In the interest of conciseness, the following descriptions focus primarily on features that are different from those described above with reference to the knob 100. While the illustrated knob 200 does not include a light modulator, it is to be appreciated that a light modulator may nonetheless be provided to the knob 200.

In the illustrated form, the front portion 210 is a single-piece construction that defines the collar 212 and the front face 214, which has an opening 215 formed therein. The sensor array 241 is aligned with the opening 215 such that the sensor array 241 is operable to sense at least one environmental condition via the opening 215. Extending from the rear of the collar 212 are a plurality of clips 213, which engage with recesses 223 formed in the rear portion 220 to releasably secure the front portion 210 and the rear portion 220 to one another.

Disposed within the chamber 203 are the light source 230 and the control circuitry 240, which are provided on a printed circuit board assembly (PCBA) 209. Mounted to the PCBA 209 is the battery 206, which provides power for the light source 230 and the control circuitry 240. In the illustrated embodiment, the battery 206 is not accessible from the exterior of the shell 202, such that the front and rear portions 210, 220 must be decoupled from one another to replace the battery 206. It is also contemplated that the battery 206 may be accessible from the exterior of the shell 202, for example via a sliding battery holder such as that illustrated in FIGS. 1-3.

Figure 7:
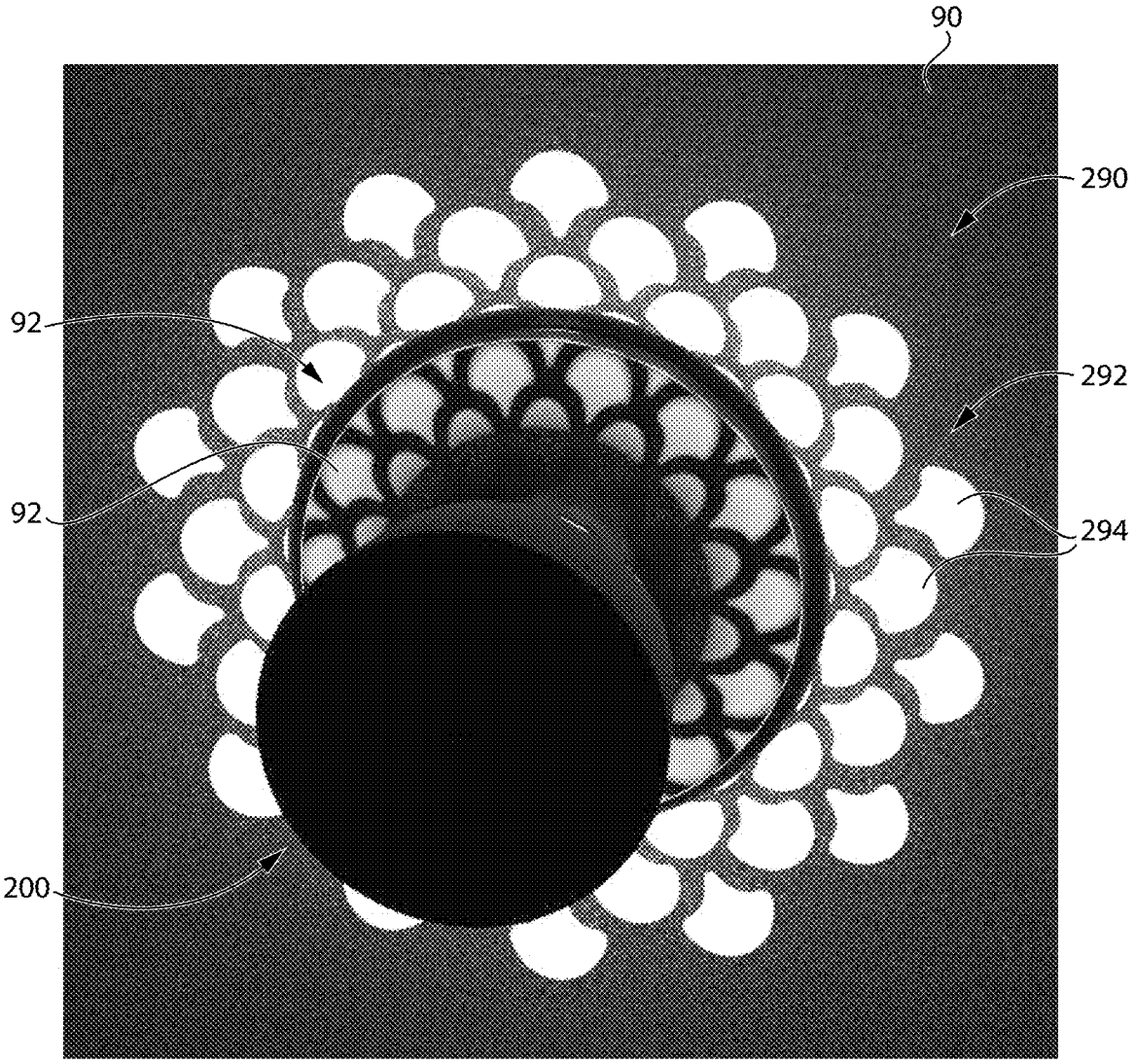
FIG. 7 is a perspective illustration of the knob of FIG. 5 casting a light pattern onto a door.

With additional reference to FIG. 7, the illustrated window pattern 280 is provided in the form of a fish-scale pattern that casts a corresponding fish-scale light pattern 290 onto the door 90 and the rose 93 of the trim 92. The window pattern 280 includes at least one opaque region 282 and a plurality of translucent or transparent regions 284 in the form of apertures or windows 285. When the light source 230 is illuminated, the window pattern 280 casts a shadow defining the light pattern 290, which includes at least one dark region 292 corresponding to the opaque region 282 and a plurality of lighted regions 294 corresponding to the windows 285.

In the embodiments described hereinabove, the window patterns 180, 280 are defined by the rear portions 120, 220 themselves, and more particularly by apertures or windows 185, 285 formed in the solid material of the rear portions 120, 220. It is also contemplated that a window pattern may be releasably attached to a rear portion such that different window patterns can be interchangeably used with the same rear portion. Certain illustrative examples of removable and interchangeable window patterns are illustrated in FIGS. 8-10.

Figure 8:
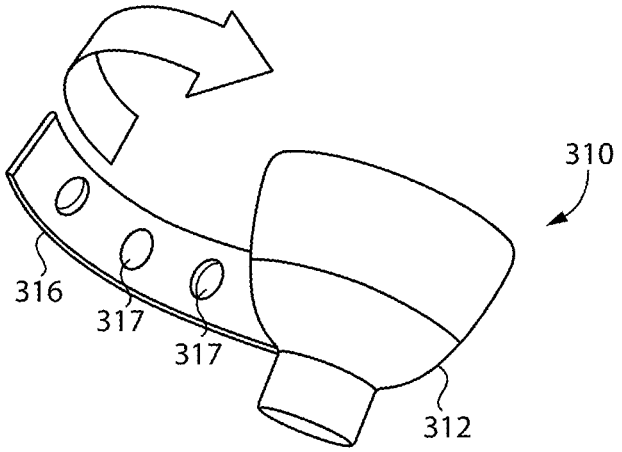
FIG. 8 is a perspective illustration of a knob according to certain embodiments.

With reference to FIG. 8, illustrated therein is a knob 310 including a transparent or translucent rear portion 312. A removable window pattern 316 including a plurality of windows 317 is releasably secured to the translucent rear portion 312, for example by adhesives or by snapping onto the rear portion 312. When a light source within the knob 310 is activated, the window pattern 316 casts a light pattern onto the door to which the knob 310 is mounted.

Figure 9:
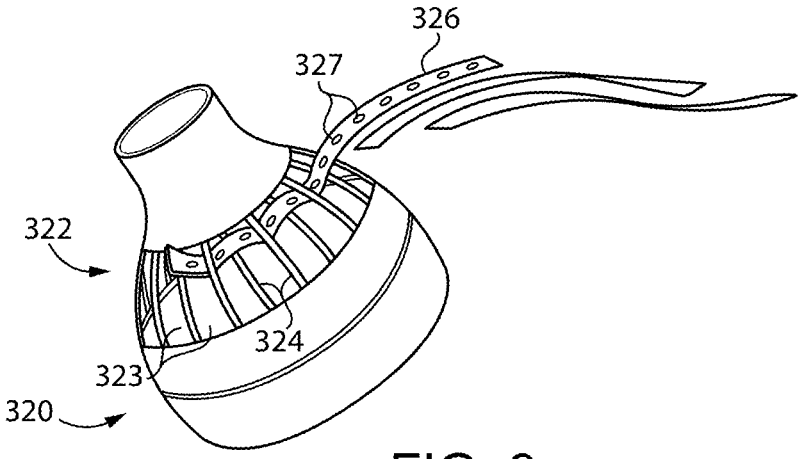
FIG. 9 is a perspective illustration of a knob according to certain embodiments.

With reference to FIG. 9, illustrated therein is a knob 320 including a rear portion 322 having apertures 323 defined between struts 324. A removable window pattern 326 in the form of a ribbon 328 is mounted to the rear portion 322. The ribbon 328 includes a plurality of windows 327, and is threaded into the struts 324 such that the apertures 323 align with the windows 327. When a light source within the knob 320 is activated, the window pattern 326 casts a light pattern onto the door to which the knob 320 is mounted.

Figure 10:
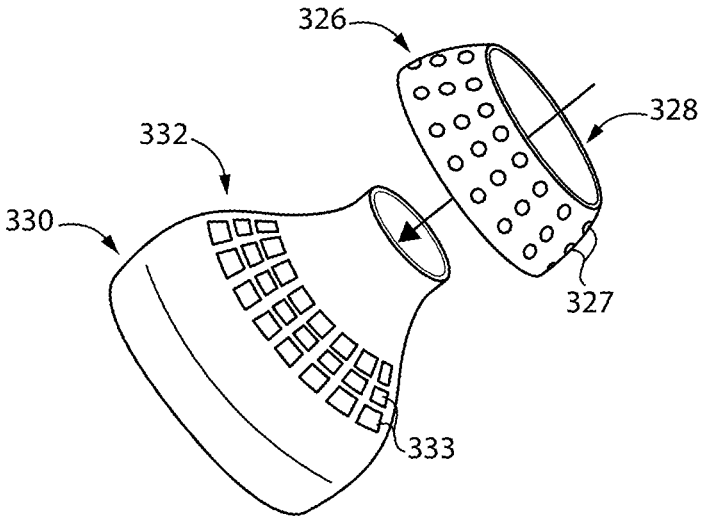
FIG. 10 is a perspective illustration of a knob according to certain embodiments.

With reference to FIG. 10, illustrated therein is a knob 330 including a rear portion 332 having apertures 333 defined therein. A removable window pattern 336 in the form of a collar 338 is mounted to the rear portion 332, for example via adhesives or mating snap features. The collar includes a plurality of windows 337 that align with the apertures 333 such that the light source of the knob 330 is operable to cast a shadow corresponding to the window pattern 336 onto the door. When a light source within the knob 330 is activated, the window pattern 336 casts a light pattern onto the door to which the knob 330 is mounted.

In the embodiments illustrated in FIGS. 8-10, the removable window patterns are removably mounted to the rear portions of the knobs, and accordingly rotate with the knobs. It is also contemplated that the removable patterns may connect to the rose 93 of the trim 92 and remain stationary while the knob is rotating.

Figure 11:
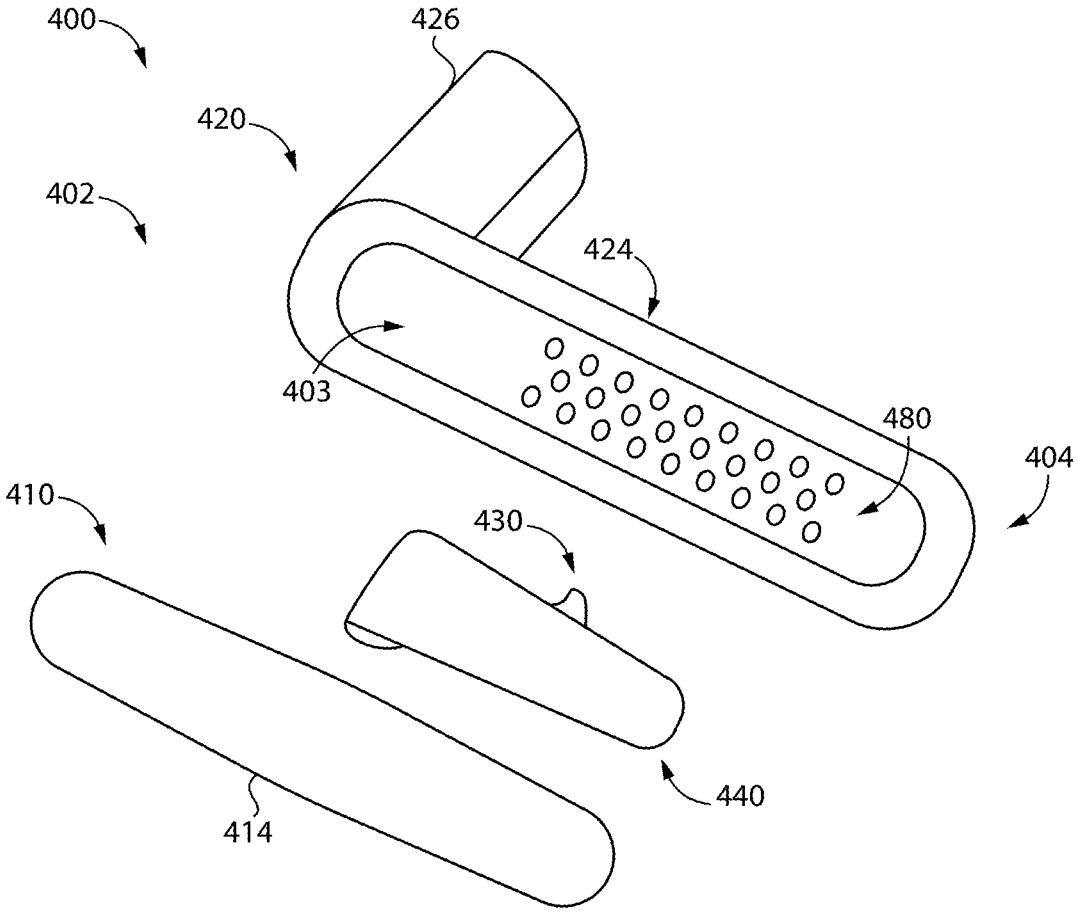
FIG. 11 is an exploded assembly view of a lever according to certain embodiments.

With additional reference to FIG. 11, illustrated therein is a lever 400 according to certain embodiments. The lever 400 is somewhat similar to the above-described knobs 100, 200, and similar reference characters are used to indicate similar elements and features. For example, the lever 400 includes a light source 430, control circuitry 440, and a shell 402 having a front portion 410 and a rear portion 420 that define a chamber 403, which respectively correspond to the above-described light source 130, control circuitry 140, and shell 102 having a front portion 110 and a rear portion 120 that define a chamber 103. In the interest of conciseness, the following descriptions focus primarily on features that are different from those described above with reference to the knob 100.

In contrast to the above-described knob 100, the shell 402 of the lever 400 defines a lever portion 404 extending from the shank 426 primarily in a single radial direction. While the illustrated window pattern 480 is defined by the rear portion 420, it is to be appreciated that interchangeable inserts may be utilized to define the window pattern 480 in a manner similar to that described above with reference to FIGS. 8-10.

While certain examples of window patterns and light patterns have been illustrated and described herein, it is to be appreciated that other forms of window patterns may be utilized to generate light patterns of other configurations. Certain examples of such light patterns are illustrated in FIG. **12*a*-12*i*. While each of the light patterns illustrated in FIGS. 12*a*-12*i*** exhibits a certain degree of rotational symmetry, it is also contemplated that a light pattern need not exhibit rotational symmetry. Additionally, while each of the illustrated light patterns includes repeating features, it is to be appreciated that a light pattern need not include such repeating features. For example, the geometries of a window pattern may be randomized to generate a non-repeating, asymmetrical light pattern.

With reference to FIG. **12*a*, illustrated therein is a knob 510 including a window pattern that displays a light pattern 512 on the door 92. The light pattern 512 includes at least one darkened region 513 and a plurality of lighted regions 514. As will be appreciated, the darkened region 513 corresponds to an opaque region of the window pattern, and each lighted region 514** corresponds to a translucent or transparent region of the window pattern.

With reference to FIG. **12*b*, illustrated therein is a knob 520 including a window pattern that displays a light pattern 522 on the door 92. The light pattern 522 includes at least one darkened region 523 and a plurality of lighted regions 524. As will be appreciated, the darkened region 523 corresponds to an opaque region of the window pattern, and each lighted region 524** corresponds to a translucent or transparent region of the window pattern.

With reference to FIG. **12*c*, illustrated therein is a knob 530 including a window pattern that displays a light pattern 532 on the door 92. The light pattern 532 includes at least one darkened region 533 and a plurality of lighted regions 534. As will be appreciated, the darkened region 533 corresponds to an opaque region of the window pattern, and each lighted region 534** corresponds to a translucent or transparent region of the window pattern.

With reference to FIG. **12*d*, illustrated therein is a knob 540 including a window pattern that displays a light pattern 542 on the door 92. The light pattern 542 includes at least one darkened region 543 and a plurality of lighted regions 544. As will be appreciated, the darkened region 543 corresponds to an opaque region of the window pattern, and each lighted region 544** corresponds to a translucent or transparent region of the window pattern.

Figure 12A:
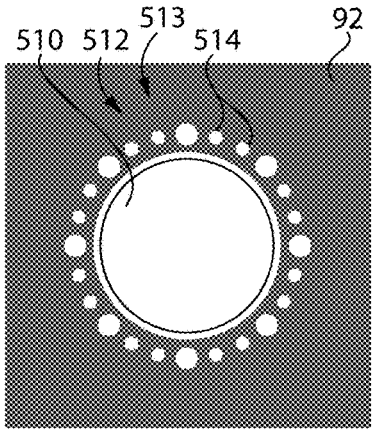
FIGS. 12*a*-12*i* illustrate light patterns according to certain embodiments.
Figure 12B:
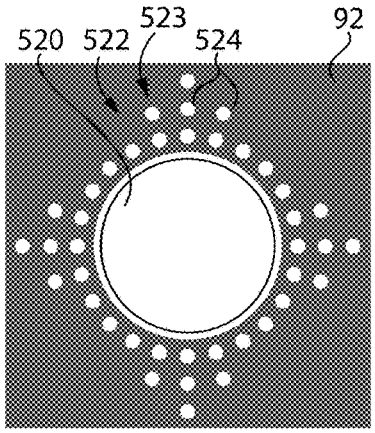
Figure 12C:
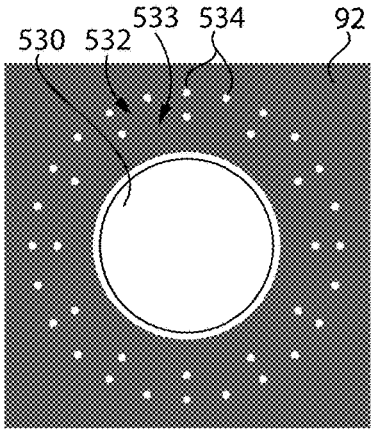
Figure 12D:
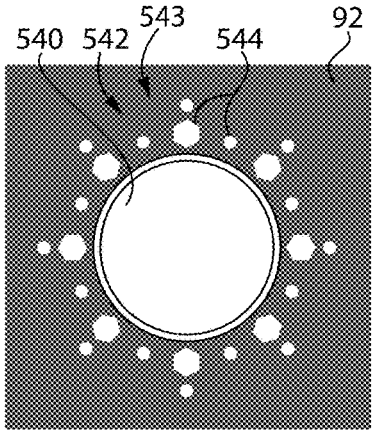
Figure 12E:
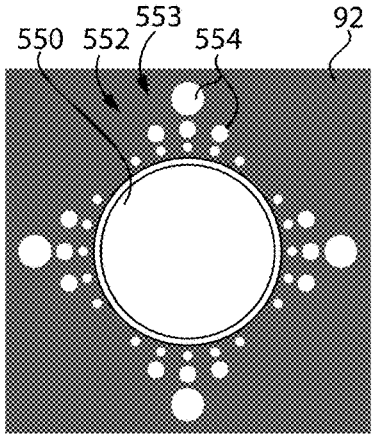

With reference to FIG. 12*e*, illustrated therein is a knob 550 including a window pattern that displays a light pattern 552 on the door 92. The light pattern 552 includes at least one darkened region 553 and a plurality of lighted regions 554. As will be appreciated, the darkened region 553 corresponds to an opaque region of the window pattern, and each lighted region 554 corresponds to a translucent or transparent region of the window pattern.

Figure 12F:
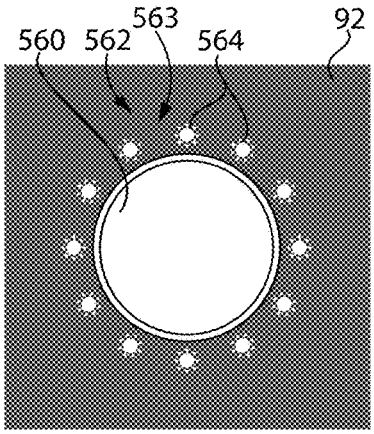

With reference to FIG. 12*f*, illustrated therein is a knob 560 including a window pattern that displays a light pattern 562 on the door 92. The light pattern 562 includes at least one darkened region 563 and a plurality of lighted regions 564. As will be appreciated, the darkened region 563 corresponds to an opaque region of the window pattern, and each lighted region 564 corresponds to a translucent or transparent region of the window pattern.

Figure 12G:
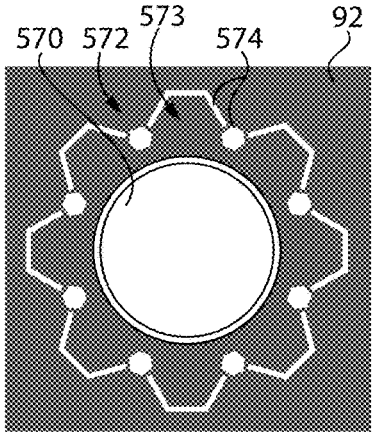

With reference to FIG. 12*g*, illustrated therein is a knob 570 including a window pattern that displays a light pattern 572 on the door 92. The light pattern 572 includes at least one darkened region 573 and a plurality of lighted regions 574. As will be appreciated, the darkened region 573 corresponds to an opaque region of the window pattern, and each lighted region 574 corresponds to a translucent or transparent region of the window pattern.

Figure 12H:
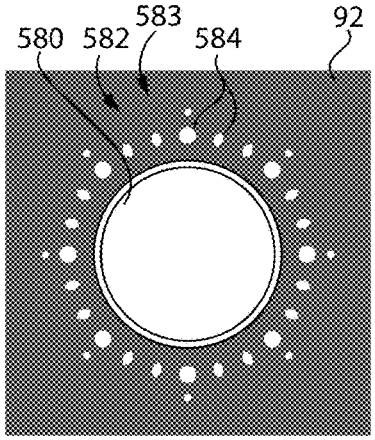

With reference to FIG. 12*h*, illustrated therein is a knob 580 including a window pattern that displays a light pattern 582 on the door 92. The light pattern 582 includes at least one darkened region 583 and a plurality of lighted regions 584. As will be appreciated, the darkened region 583 corresponds to an opaque region of the window pattern, and each lighted region 584 corresponds to a translucent or transparent region of the window pattern.

Figure 12I:
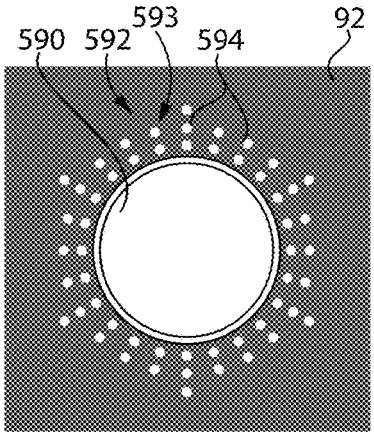

With reference to FIG. 12*i*, illustrated therein is a knob 590 including a window pattern that displays a light pattern 592 on the door 92. The light pattern 592 includes at least one darkened region 593 and a plurality of lighted regions 594. As will be appreciated, the darkened region 593 corresponds to an opaque region of the window pattern, and each lighted region 594 corresponds to a translucent or transparent region of the window pattern.

In certain embodiments described hereinabove, the light pattern is generated by passing light from a light source through a window pattern corresponding to the light pattern. In certain embodiments, the window pattern may include translucent colored components to generate the light pattern with different colors. In some embodiments, the translucent colored components may be fixed in place, while in other embodiments the translucent colored components may be movable. For example, a knob may include movable translucent colored components and a mirror arrangement to define a kaleidoscope that displays a varying light pattern as the movable colored segments shift.

In certain embodiments, the light pattern may be generated by passing through the window pattern. Additionally or alternatively, the light pattern may be generated by the light source itself. For example, a light source may be provided as a projector having programmed therein a plurality of patterns that the projector is operable to display.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A door handle configured for mounting to a door, the door handle comprising:

a front portion coupled to a rear portion that together define an internal chamber;

a light source positioned in the internal chamber with the rear portion of the door handle located between the light source and the door; and a window pattern defined by the rear portion of the door handle, the window pattern projecting a light pattern onto a surface, the light pattern including at least one darkened region and at least one lighted region the window pattern including at least one opaque region and at least one transparent or translucent region, the at least one darkened region corresponding to the at least one opaque region and the at least one lighted region corresponding to the at least one transparent or translucent region.

2. The door handle of claim 1, wherein the rear portion of the door handle includes an opening sized and shaped to receive a spindle of a trim mounted to the door.

3. The door handle of claim 1, further comprising a light modulator associated with the light source.

4. The door handle of claim 1, wherein the window pattern comprises a plurality of windows defined in the rear portion of the door handle.

5. The door handle of claim 1, wherein the window pattern is releasably mounted to the door handle.

6. An apparatus comprising the door handle of claim 1, the apparatus further comprising a trim configured for mounting to the door, the trim including a latchbolt, and wherein the door handle is mounted to the trim such that rotation of the door handle about a rotational axis causes retraction of the latchbolt.

7. The door handle of claim 1, further comprising control circuitry configured to selectively activate the light source based on information received from a sensor array.

8. The door handle of claim 7, further comprising the sensor array.

9. The door handle of claim 8, wherein the sensor array comprises:

an ambient light sensor, wherein the control circuitry is configured to activate the light source based on a sensed level of ambient light being below a threshold level; and a motion sensor, wherein the control circuitry is configured to activate the light source based a sensed presence of a user.

10. The door handle of claim 1, further comprising a light modulator positioned adjacent the light source to provide the light pattern.

11. The door handle of claim 1, wherein the front portion of the door handle is removably attached to the rear portion of the door handle.

12. The door handle of claim 1, wherein at least a portion of the window pattern is defined by a rear surface of the door handle facing the door.

13. The door handle of claim 1, wherein at least a portion of the window pattern faces the door so as to project at least a portion of the light pattern onto the door.

14. The door handle of claim 1, further comprising a shank extending from the rear portion of the door handle toward the door.

15. A method, comprising:

projecting a light pattern from a light source positioned in an internal chamber defined between a front portion and a rear portion of a door handle, the light pattern including at least one darkened region and at least one lighted region;

wherein the projecting comprises passing light through a window pattern defined by the rear portion of the door handle, the rear portion of the door handle located between the light source and a door;

wherein the window pattern comprises at least one opaque region corresponding to the at least one darkened region; and wherein the window pattern comprises at least one transparent or translucent region corresponding to the at least one lighted region.

16. The method of claim 15, further comprising:

removing the window pattern from the door handle;

replacing the window pattern with a second window pattern different from the window pattern; and projecting light from the light source through the second window pattern such that a second light pattern corresponding to the second window pattern is displayed on the surface.

17. The method of claim 15, further comprising passing the light through a light modulator.

18. The method of claim 17, wherein passing the light through the light modulator diffuses and/or diffracts the light.

19. A door handle, comprising:

a body portion including a front portion coupled to a rear portion that together define an internal chamber, the rear portion comprising a window pattern including an opaque region and a transparent or translucent region;

a light source positioned in the internal chamber with the rear portion of the door handle located between the light source and a door; and control circuitry in communication with the light source and a sensor array;

wherein the control circuitry is configured to selectively activate the light source based on information generated by a sensor array to thereby cause the light source project a light pattern corresponding to the window pattern onto a surface; and wherein the light pattern comprises a darker region corresponding to the opaque region and a lighter region corresponding to the transparent or translucent region.

20. The door handle of claim 19, wherein the window pattern comprises a plurality of windows; and wherein at least one window of the plurality of windows is positioned at a location other than a front face of the body portion.

21. The door handle of claim 19, further comprising the sensor array, wherein the sensor array comprises at least one sensor mounted to the body portion.

22. The door handle of claim 19, wherein the sensor array comprises:

an ambient light sensor, wherein the control circuitry is configured to activate the light source based on a sensed level of ambient light being below a threshold level; and a motion sensor, wherein the control circuitry is configured to activate the light source based a sensed presence of a user.

23. The door handle of claim 19, wherein the front portion of the door handle is removably attached to the rear portion of the door handle.

24. The door handle of claim 19, wherein at least a portion of the window pattern faces the door so as to project at least a portion of the light pattern onto the door.

* * * * *